US007850162B2

(12) United States Patent
Imai et al.

(10) Patent No.: US 7,850,162 B2
(45) Date of Patent: Dec. 14, 2010

(54) SHEET FEEDING DEVICE AND IMAGE FORMING APPARATUS

(75) Inventors: Yusuke Imai, Toride (JP); Taro Ikeda, Tokyo (JP); Hiroto Koga, Abiko (JP); Fumihiko Hirata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 11/942,107

(22) Filed: Nov. 19, 2007

(65) Prior Publication Data

US 2008/0143037 A1 Jun. 19, 2008

(30) Foreign Application Priority Data

Dec. 19, 2006 (JP) ..... 2006-341408

(51) Int. Cl.
*B65H 7/02* (2006.01)

(52) U.S. Cl. ..... 271/31; 271/97; 271/98

(58) Field of Classification Search ..... 271/31, 271/98, 97

See application file for complete search history.

(56) References Cited

U.S. PATENT DOCUMENTS

| | | | | |
|---|---|---|---|---|
| 4,382,593 | A * | 5/1983 | Beran et al. | 271/12 |
| 5,090,676 | A * | 2/1992 | Matsuno et al. | 271/12 |
| 5,135,213 | A * | 8/1992 | Malachowski et al. | 271/104 |
| 5,645,274 | A * | 7/1997 | Ubayashi et al. | 271/94 |
| 6,609,708 | B2 * | 8/2003 | Moore et al. | 271/98 |
| 7,458,570 | B2 * | 12/2008 | Ueda et al. | 271/97 |
| 2001/0017441 | A1 * | 8/2001 | Yamaguchi et al. | 271/94 |

FOREIGN PATENT DOCUMENTS

| | | |
|---|---|---|
| JP | 7-196187 | 8/1995 |

* cited by examiner

*Primary Examiner*—Patrick Mackey
*Assistant Examiner*—Ernesto Suarez
(74) *Attorney, Agent, or Firm*—Canon USA Inc IP Div

(57) ABSTRACT

A sheet feeding device blows air on a sheet stack supported on a tray, raises several sheets, attracts an uppermost sheet to an attraction conveying belt, and conveys the attracted sheet. The sheet feeding device includes a next-sheet detection mechanism for detecting the height of a second sheet subsequent to the uppermost sheet.

12 Claims, 16 Drawing Sheets

SHEET FEEDING DEVICE AND IMAGE FORMING APPARATUS

BACKGROUND OF THE INVENTION

1. Field of the Invention

The present invention relates to a sheet feeding device that feeds sheets one by one from a repository in which a plurality of sheets are accommodated and to an image forming apparatus including the sheet feeding device.

2. Description of the Related Art

Image forming apparatuses, such as printers and copiers, include a sheet feeding device for supplying sheets one by one to an image forming portion from a repository in which sheets are accommodated. One such example is a sheet feeding device that blows air on an end of a sheet stack accommodated in a repository, raises several sheets, attracts the uppermost sheet of the raised sheets to a attraction conveying belt, and conveys the attracted sheet (hereinafter, this type of sheet feeding device is sometimes referred to as an air-blowing sheet feeding device). This technique is disclosed in Japanese Patent Laid-Open No. 7-196187 (corresponding to U.S. Pat. No. 5,645,274).

One example of a known air-blowing sheet feeding device is described below with reference to FIGS. 15 and 16.

As illustrated in FIG. 15, a repository 11 is provided with a tray 12 supporting sheets S. An attraction conveying portion for attracting and conveying a sheet is disposed above the sheet stack supported on the tray 12. An air blowing portion for raising a plurality of sheets in the upper part of the sheet stack supported on the tray 12 and loosening them is disposed adjacent to a side of the repository 11.

The attraction conveying portion includes a rotatable attraction conveying belt 21 looped around belt driving rollers 41. The attraction conveying belt 21 attracts a sheet and conveys it rightward in FIG. 15. The attraction conveying belt 21 is connected to an attraction mechanism for attracting a sheet. The attraction mechanism includes an attraction fan 36 for producing a negative pressure and a suction duct 51 for sucking air through a suction port formed in the attraction conveying belt 21. The suction duct 51 is connected to the attraction fan 36 and disposed inside the attraction conveying belt 21. An attraction shutter 37 for switching on and off an attraction operation is disposed between the attraction fan 36 and the suction duct 51.

The air blowing portion includes a loosening nozzle 33 and a separation nozzle 34 for blowing air on the upper part of a sheet stack supported on the tray 12 from the side. Air is supplied from a separation fan 31 to the loosening nozzle 33 and the separation nozzle 34 through a separation duct 32. Air drawn from the separation fan 31 in a direction indicated by the arrow C in FIG. 15 is blown in a direction indicated by the arrow D through the loosening nozzle 33 and is also blown in a direction indicated by the arrow E through the separation nozzle 34. The air blown in the direction of the arrow D raises several sheets in the upper part of the sheet stack supported on the tray 12 and loosens them. The air blown in the direction of the arrow E separates the uppermost sheet from the other sheets and attracts it to the attraction conveying belt 21.

To reliably attract the sheets S to the attraction conveying belt 21 one by one, it is necessary to set the uppermost surface of the sheet stack supported on the tray 12 at a height suited for attraction. To this end, an uppermost-sheet detection mechanism 49 (see FIG. 16) for detecting the position of the uppermost surface of the sheet stack supported on the tray 12 is provided. In accordance with detection by the uppermost-sheet detection mechanism 49, the tray 12 is moved upward and downward.

As illustrated in FIG. 16, the uppermost-sheet detection mechanism 49 includes a sensor lever 52 rotatably supported by a support shaft 53 and a sheet surface sensor 54. The leading end of the sensor lever 52 comes into contact with the uppermost surface of the sheet stack and the sensor lever 52 rotates, thus switching on or off the sheet surface sensor 54 and causing the sheet surface sensor 54 to output a signal. In accordance with the signal from the sheet surface sensor 54, a control unit (not shown) controls the upward and downward movements of the tray 12 to set the uppermost surface of the sheet stack at a height suited for attraction.

To feed the sheets S, after the uppermost sheet Sa is moved at a height suited for attraction by movement of the tray 12 upward or downward by use of the uppermost-sheet detection mechanism 49, the uppermost sheet Sa is attracted to the attraction conveying belt 21 by operation of the attraction fan 36. In response to a sheet feed signal Cf output from a printer body, the attraction conveying belt 21 to which the uppermost sheet Sa is attracted is rotated, thus delivering the uppermost sheet Sa to a pair of drawing rollers 42 disposed downstream. After the uppermost sheet Sa passes through the attraction conveying belt 21, the attraction conveying belt 21 is stopped, the upward and downward movements of the tray 12 are controlled by use of the uppermost-sheet detection mechanism 49 to set the next sheet Sb at a height suited for attraction to the attraction conveying belt 21.

In known sheet feed operations, after the rear end of the attracted and conveyed uppermost sheet Sa passes through the attraction conveying belt 21, the height of the next sheet Sb is detected by the uppermost-sheet detection mechanism 49. In accordance with the detection, the upward and downward movements of the tray 12 are controlled.

Unfortunately, such known techniques have the following problems.

The uppermost-sheet detection mechanism 49 detects the height of the sheets S by use of the sensor lever 52 coming into contact with the uppermost surface of the sheets S supported on the tray 12. As illustrated in FIG. 16, during operation of continuously feeding sheets, the sensor lever 52 cannot come into contact with the upper surface of the next sheet Sb to be next attracted until the preceding uppermost sheet Sa has passed through the leading end of the sensor lever 52. Accordingly, the position of the upper surface of the sheet Sb cannot be detected until then.

That is, after the uppermost sheet Sa has passed through the attraction conveying portion, whether the upper surface of the next sheet Sb to be next attracted lies in a predetermined position by use of the uppermost-sheet detection mechanism 49 is determined. In accordance with the determination, the upward and downward movements of the tray 12 are controlled. As a result, when the sheets are not raised smoothly and the raised position of the next sheet Sb is low, the time required for lifting the tray 12 to upwardly move the next sheet Sb to a predetermined range is undesirably increased. The interval between sheets during continuous feed operation is long, and productivity in the image forming portion is decreased. In particular, in the case of a sheet having a heavy basis weight or having a large size, its raised state is unstable. This may significantly decrease productivity.

SUMMARY OF THE INVENTION

The present invention provides a sheet feeding device that uses air blowing, achieves reduced loss of time in control for sheet feeding, and has an increased productivity in sheet feeding.

According to an aspect of the present invention, a sheet feeding device includes a tray, an air blowing portion, an attraction conveying portion, and a next-sheet detection mechanism. The tray is configured to support sheets and is movable upward and downward. The air blowing portion is configured to blow air for raising sheets supported on the tray. The attraction conveying portion is configured to attract an uppermost sheet of the sheets raised by the air blowing portion and to convey the attracted sheet. The next-sheet detection mechanism is configured to detect a height of a next sheet subsequent to the uppermost sheet when the air blowing portion is raising the sheets.

Further features of the present invention will become apparent from the following description of exemplary embodiments (with reference to the attached drawings).

DESCRIPTION OF THE EMBODIMENTS

Embodiments according to the present invention are described below with reference to the accompanying drawings.

Figure 1:
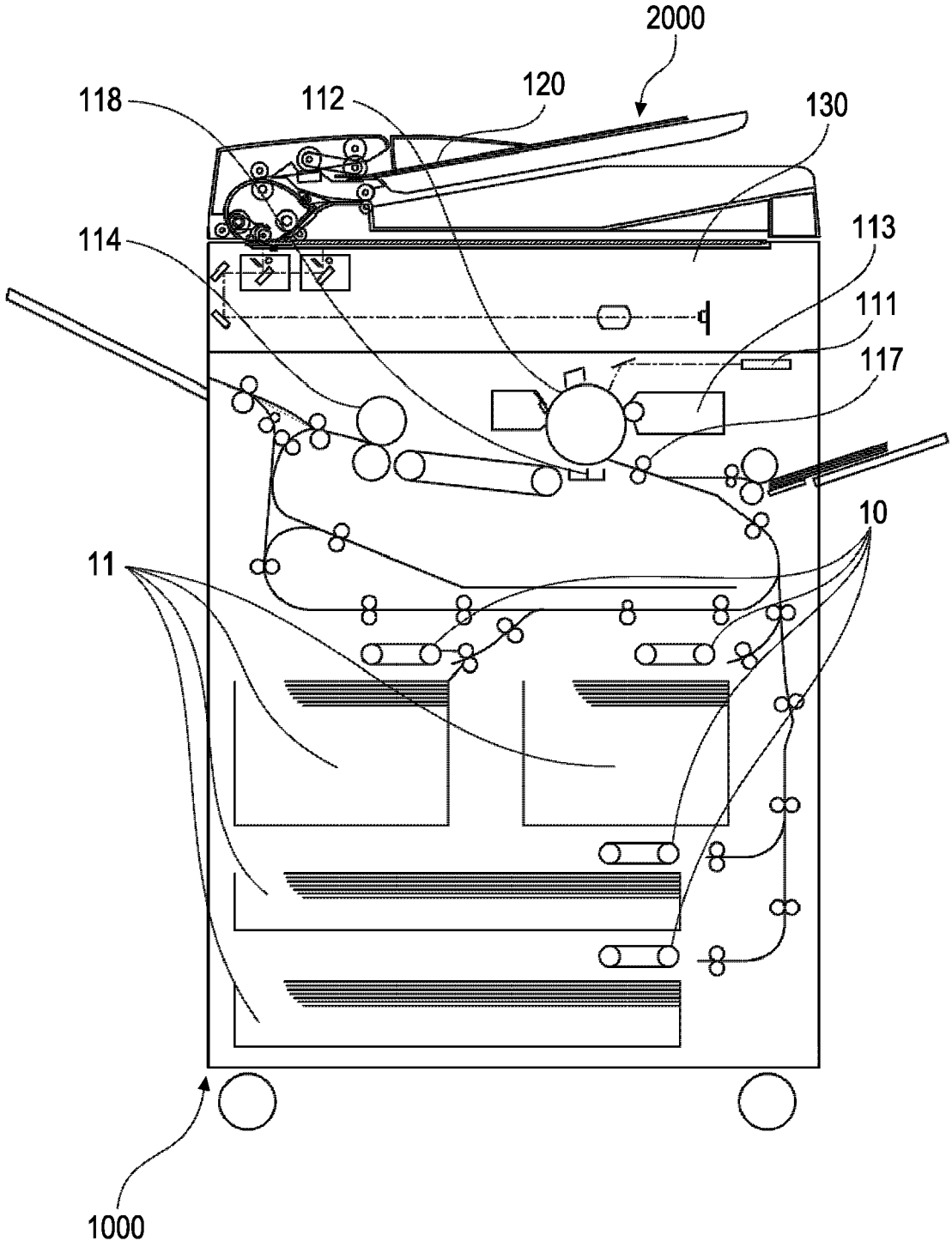
FIG. 1 is a cross-sectional view of an image forming apparatus that includes an air-blowing sheet feeding device according to a first embodiment of the present invention.

FIG. 1 is a schematic cross-sectional view of an image forming apparatus that includes a sheet feeding device to which the present invention is applied. A scanning apparatus 2000 is disposed on the upper portion of an image forming apparatus body (hereinafter referred to as a printer body) 1000. The scanning apparatus 2000 operates such that a document conveying portion 120 automatically conveys a document to a reading position for a document reader portion 130, and the document reader portion 130 reads image information regarding the document. The image information read by the document reader portion 130 is processed by a controller (not shown). In an image forming portion in the printer body 1000, in response to a signal based on a result of processing performed by the controller, a laser scanning unit 111 emits a laser beam, and an electrostatic latent image is formed on a photosensitive drum 112.

A sheet feeding device 10 for supplying a sheet to the image forming portion is disposed in the lower part of the printer body 1000. The sheet feeding device 10 includes a repository 11 capable of being drawn from the printer body 1000 and an air-blowing sheet feeding mechanism including attraction conveying belts 21, which will be described below. Sheets of paper or sheets of overhead transparency (OHT) accommodated in the repository 11 are fed from the sheet feeding mechanism toward the image forming portion.

The image forming portion operates as described below. A developer 113 develops an electrostatic latent image formed on the photosensitive drum 112. A transferring portion 118 transfers the developed toner image on the photosensitive drum 112 to a sheet synchronized in a registration portion 117. The sheet is guided to a pair of fixing rollers 114 and heated and pressed to permanently fix the toner image. The sheet is then ejected.

The details of the sheet feeding device 10 will now be described below.

Figure 2:
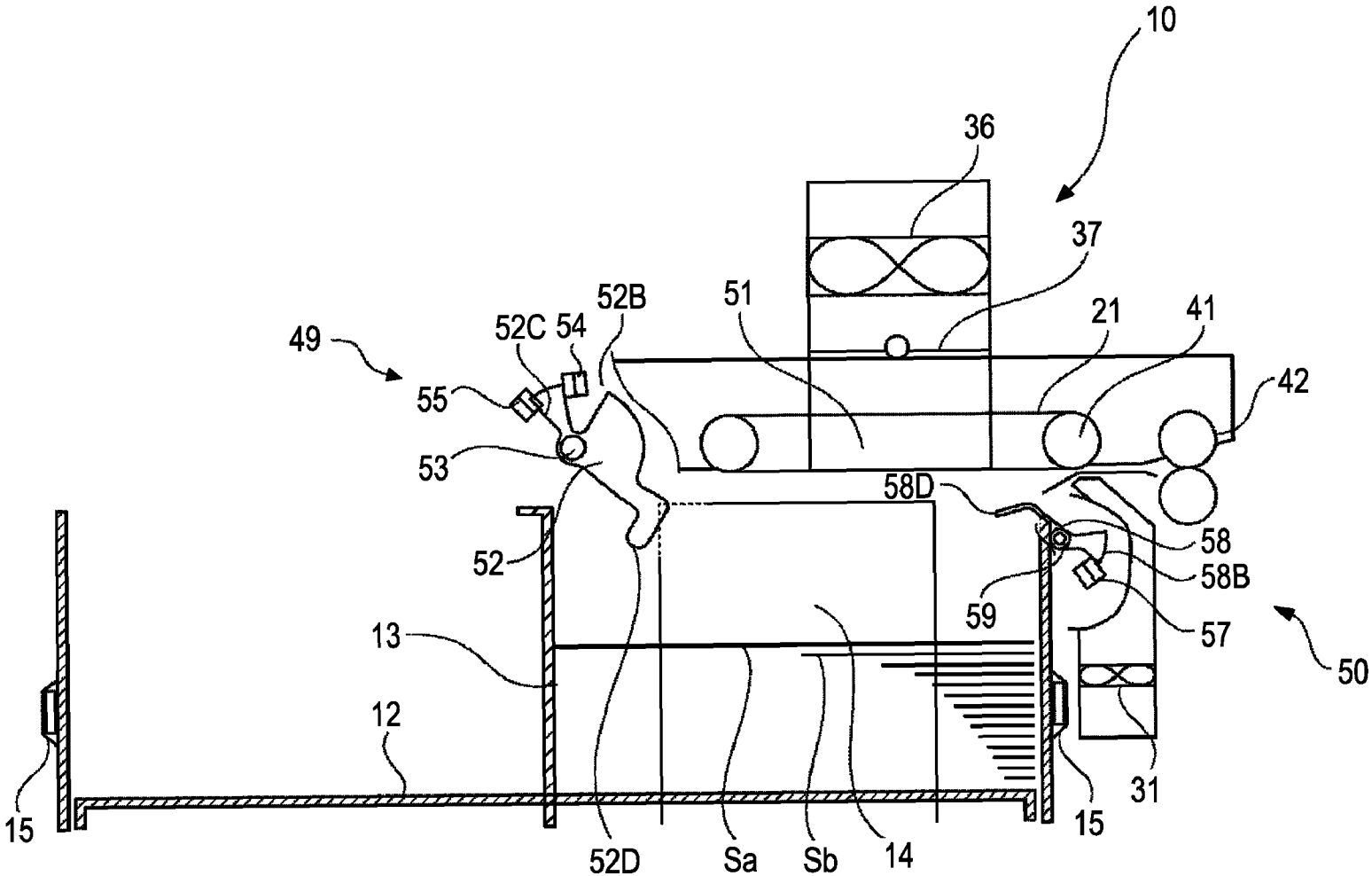
FIG. 2 is a cross-sectional view that illustrates the details of the sheet feeding device shown in FIG. 1.

Referring to FIG. 2, the repository 11 includes a tray 12 for supporting a plurality of sheets, a rear-end regulator 13 for regulating an upstream (rear) end of the sheets in a sheet feed direction, and a side-end regulator 14 for regulating a side of the sheets in a direction orthogonal to the sheet conveying direction (the direction of the sheet width). The position of each of the rear-end regulator 13 and the side-end regulator 14 can be freely changed depending on the size of an accommodated sheet. The tray 12 is movable upward and downward by a driving portion M (illustrated in FIG. 7). Examples of the driving portion M include a stepper motor and a DC servomotor. The driving portion M controlled based on detection of the position of the uppermost surface of a sheet stack placed on the tray 12 by a sheet surface detection mechanism, which will be described below, moves the tray 12 upward or downward. Accordingly, the uppermost surface of the sheet stack on the tray 12 can be adjusted so as to be at a predetermined height.

The repository 11 can be drawn from the printer body 1000 by use of, for example, a slider rail 15. When the repository 11 is drawn from the printer body 1000, the tray 12 automatically descends to a predetermined position. This allows the tray 12 to receive sheets to be added or new sheets with which the current sheets are to be replaced.

An attraction conveying portion for conveying a sheet using attraction is disposed above the sheet stack supported on the tray 12 in the repository 11. An air blowing portion for raising a plurality of sheets in the upper part of the sheet stack supported on the tray 12 and loosening them is disposed adjacent to a side of the repository 11 (a front side in the sheet feed direction).

The attraction conveying portion includes the rotatable attraction conveying belts 21 looped around belt driving rollers 41. Each of the attraction conveying belts 21 attracts a sheet and conveys the sheet rightward in FIG. 2. The belt driving rollers 41 are coupled to a driving portion D (illustrated in FIG. 7) having a driving motor. The attraction conveying belt 21 is rotated in accordance with control of the driving portion D. The attraction conveying belt 21 is connected to an attraction mechanism for attracting a sheet to the attraction conveying belt 21.

The attraction mechanism includes an attraction fan 36 for producing a negative pressure and a suction duct 51 for sucking air through a suction port formed in the attraction conveying belt 21. The suction duct 51 is connected to the attraction fan 36 and disposed inside the attraction conveying belt 21. A rotatable attraction shutter 37 for switching on and off an attraction operation is disposed between the attraction fan 36 and the suction duct 51. In FIG. 2, the attraction operation is in an off state by operation of the attraction shutter 37. Typically, two or three attraction conveying belts 21 are arranged at predetermined intervals in the direction of the sheet width.

Figure 15:
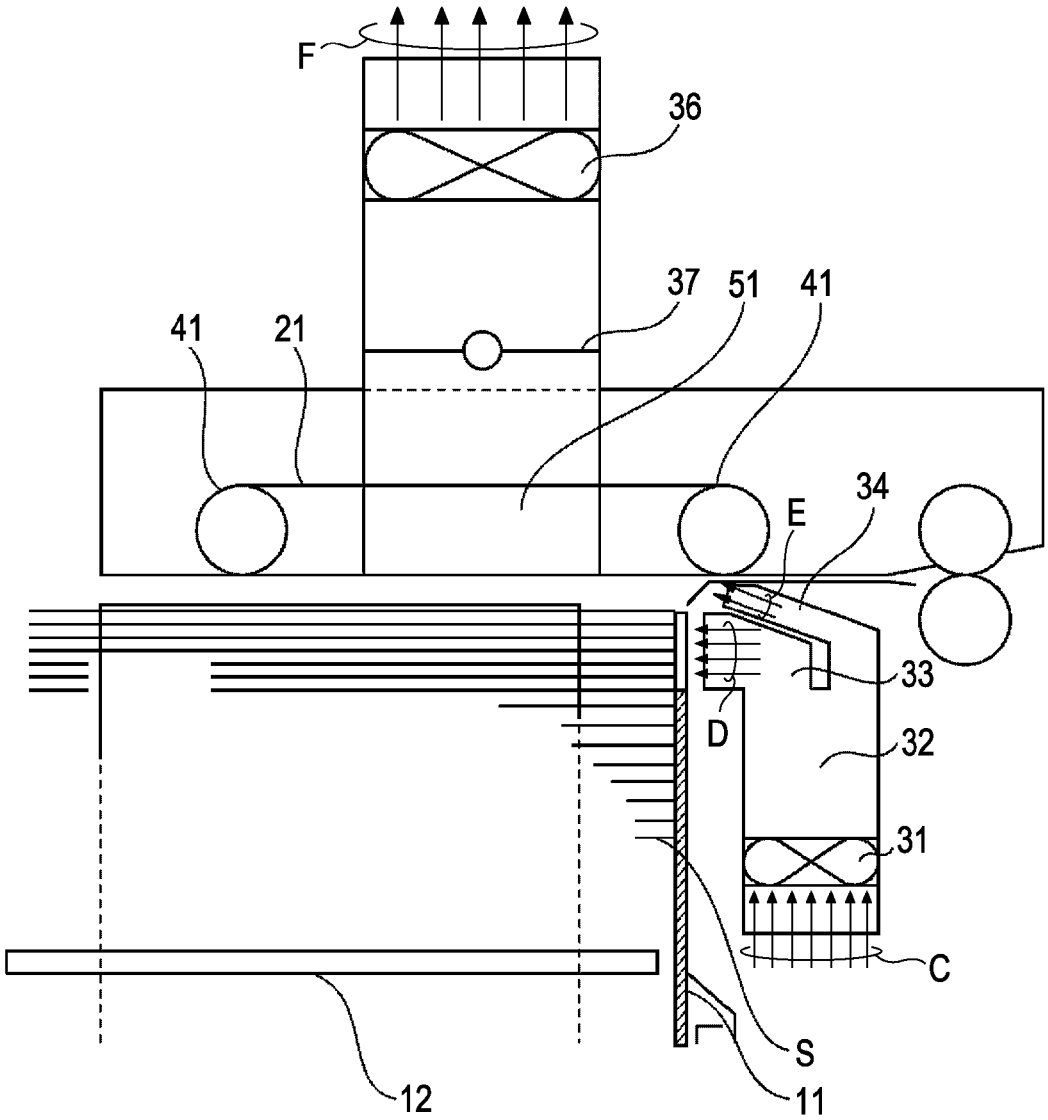
FIG. 15 PRIOR ART
FIG. 15 is a cross-sectional view of an example of a known air-blowing sheet feeding device.
Figure 16:
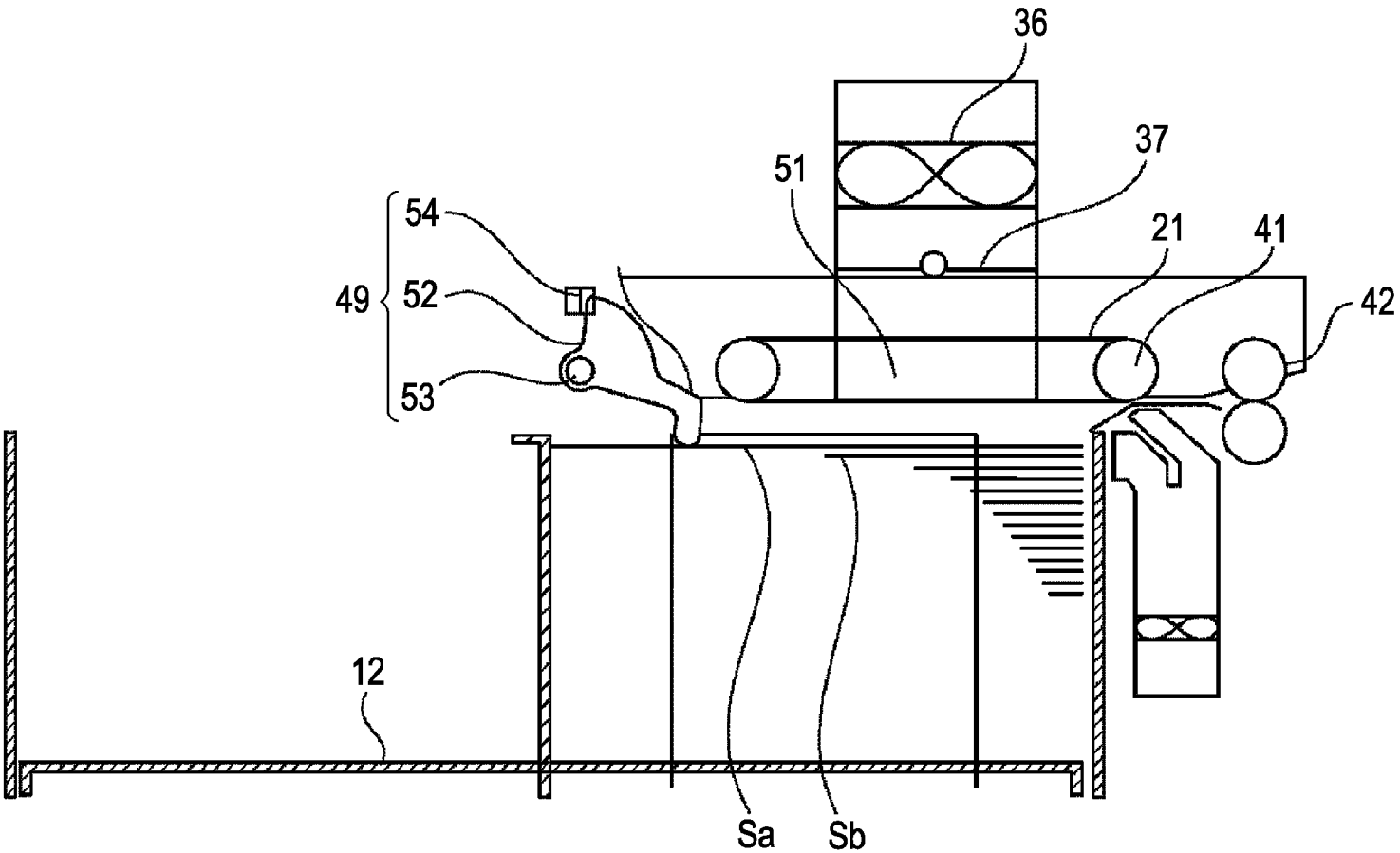
FIG. 16 PRIOR ART
FIG. 16 is another cross-sectional view of the known air-blowing sheet feeding device.

The air blowing portion can have a similar structure to a known structure, so the details are not illustrated in FIG. 2. As illustrated in FIG. 15, the air blowing portion includes a loosening nozzle 33 and a separation nozzle 34. Air is supplied from a separation fan 31 to the loosening nozzle 33 and the separation nozzle 34 through a separation duct 32. Air drawn from the separation fan 31 is blown on a side end face of an upper part of the sheet stack through the loosening nozzle 33. The blown air raises several sheets in the upper part of the sheet stack supported on the tray 12 of the repository 11. The raised sheets are separated one from the other by air blown through the separation nozzle 34. The uppermost sheet Sa is attracted to the attraction conveying belt 21.

Figure 7:
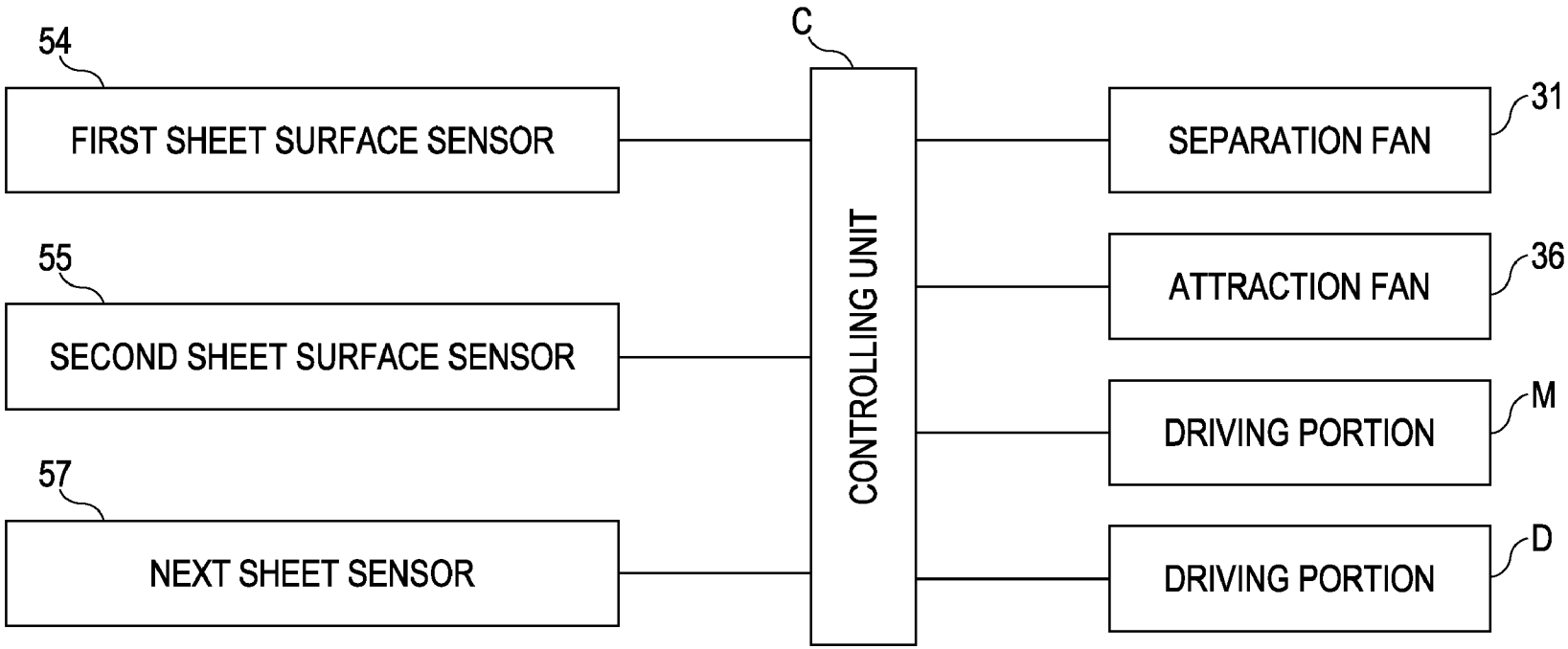
FIG. 7 is a block diagram of a control portion of the sheet feeding device shown in FIG. 1.

As illustrated in a block diagram of FIG. 7, the driving portion M for the tray 12, the driving portion D for the attraction conveying belt 21, the separation fan 31, and the attraction fan 36 are controlled by a controlling unit C in accordance with detection of surface sensors 54, 55, and 57, which will be described below.

An uppermost-sheet detection mechanism 49 for detecting the position of an upper surface of the uppermost sheet Sa of the sheet stack on the tray 12 and a next-sheet detection mechanism 50 for detecting the position of an upper surface of the second sheet Sb counting from the top of the sheet stack on the tray 12 will now be described below.

Figure 3:
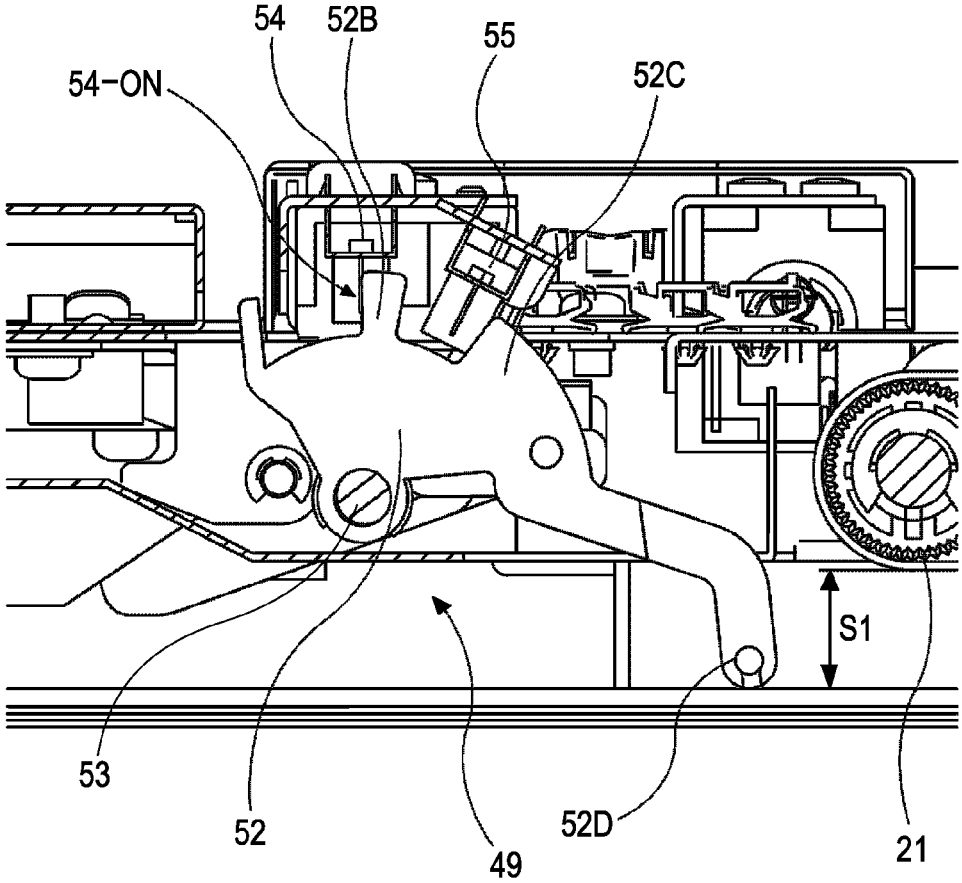
FIG. 3 is a cross-sectional view that illustrates the details of an uppermost-sheet detection mechanism of the sheet feeding device shown in FIG. 1.

As illustrated in FIG. 3, the uppermost-sheet detection mechanism 49 includes an uppermost-surface sensor lever 52 rotatably supported by a support shaft 53, a first sheet surface sensor 54, and a second sheet surface sensor 55. As illustrated in FIG. 2, the next-sheet detection mechanism 50 includes a next-sheet sensor lever 58 rotatably supported by a support shaft 59 and a next-sheet sensor 57. In accordance with an ON signal from these sheet surface sensors 54, 55, and 57, the controlling unit C controls the driving portion M to move the tray 12 upward or downward.

The uppermost-surface sensor lever 52 includes a contact section 52D to be in contact with the upper surface of the uppermost sheet Sa of the sheet stack, a first detection section 52B capable of shielding the first sheet surface sensor 54 from light, and a second detection section 52C capable of shielding the second sheet surface sensor 55 from light. Movement of the contact section 52D in accordance with the position of the uppermost surface of the uppermost sheet Sa supported on the tray 12 rotates the uppermost-surface sensor lever 52. In accordance with the rotation position of the uppermost-surface sensor lever 52, the first detection section 52B selectively shields the first sheet surface sensor 54 from light and the second detection section 52C selectively shields the second sheet surface sensor 55 from light, thus causing each of the sheet surface sensors 54 and 55 to output an ON signal. The next-sheet sensor lever 58 includes a contact section 58D to be in contact with the upper surface of the sheet and a detection section 58B capable of shielding the next-sheet sensor 57 from light. The contact section 58D shields the next-sheet sensor 57 from light, thus causing the next-sheet sensor 57 to output an ON signal. The sensor levers 52 and 58 are urged in a direction to urge their respective contact sections in contact with the upper surface of the sheet by their own weights or a resilient member (e.g., a light spring).

For the uppermost-sheet detection mechanism 49, the uppermost-surface sensor lever 52 comes into contact with the upper surface of the uppermost sheet Sa from above the sheet. Accordingly, together with an ascent of the uppermost sheet Sa to a position where the upper surface of the uppermost sheet Sa is in contact with the attraction conveying belt 21 after an attraction operation starts, the contact section 52D of the uppermost-surface sensor lever 52 also moves toward the attraction conveying belt 21. At this time, shielding the first sheet surface sensor 54 from the light continues, and therefore, the first sheet surface sensor 54 outputs an ON signal.

Figure 9:
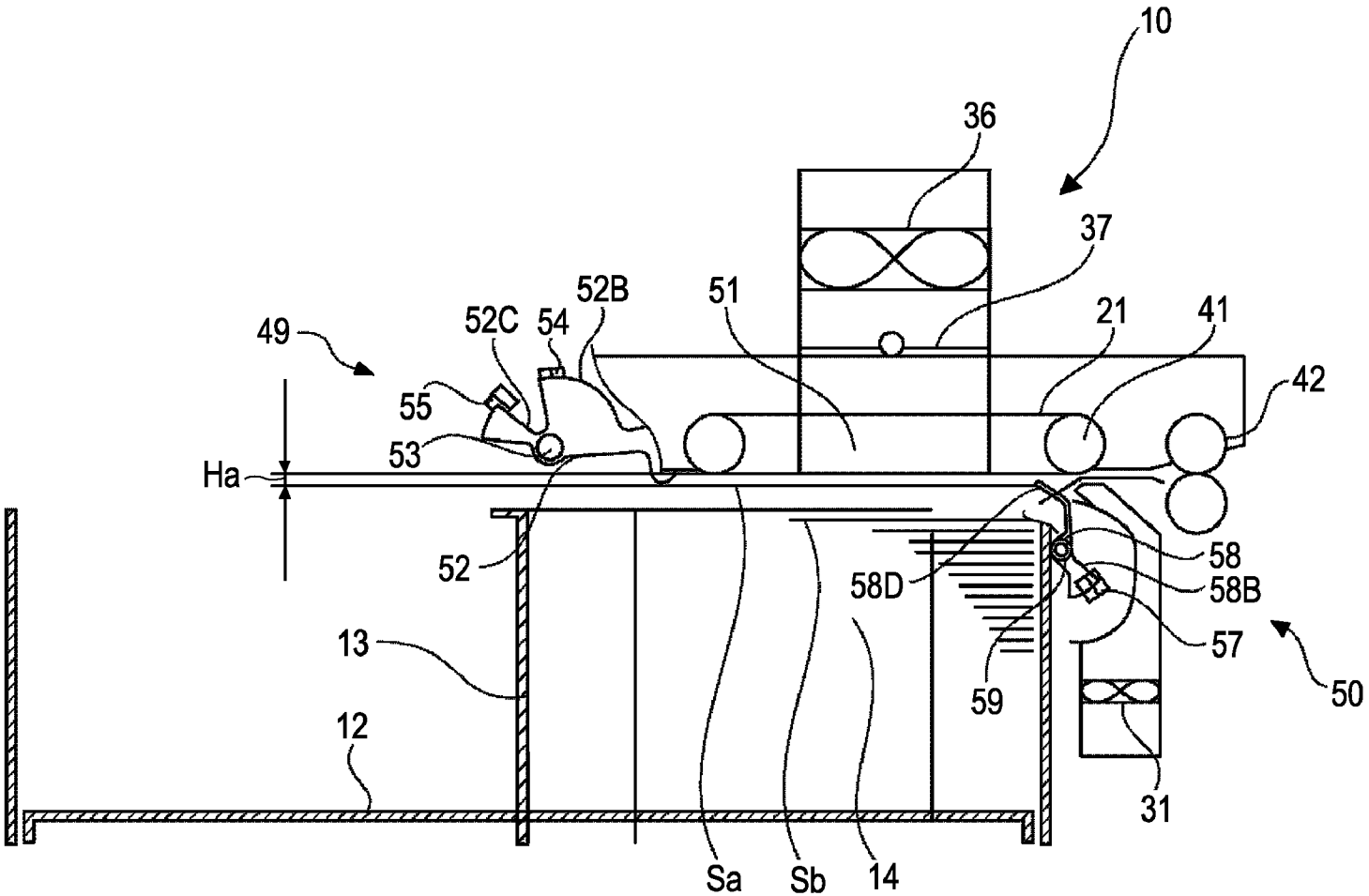
FIG. 9 is another illustration for describing an operation of the sheet feeding device shown in FIG. 1.

For the next-sheet detection mechanism 50, the contact section 58D of the next-sheet sensor lever 58 comes into contact with the upper surface of the sheet from a side of the sheet. Before the air blowing portion blows air on the side end of the upper part of the sheet stack, the contact section 58D of the next-sheet sensor lever 58 is in contact with the upper surface of the uppermost sheet Sa. When the air blowing portion blows air and an attraction operation starts, in a period during which the uppermost sheet Sa is raised and the upper surface thereof is attracted to the attraction conveying belt 21, the contact section 58D is initially in contact with the upper surface of the uppermost sheet Sa, and the contact section 58D then moves upward together with a raising of the uppermost sheet Sa. When the uppermost sheet Sa is moved upward to a position where the uppermost sheet Sa is remote from an attraction surface of the attraction conveying belt 21 by a certain distance Ha (illustrated in FIG. 9), the contact section 58D is separated from the upper surface of the uppermost sheet Sa. Then, the next-sheet sensor lever 58 is rotated about the support shaft 59, and the contact section 58D comes into contact with the upper surface of the second sheet Sb, which is subsequent to the uppermost sheet Sa. Depending on the position of the next sheet Sb when the contact section 58D of the next-sheet sensor lever 58 comes into contact with the upper surface of the second sheet Sb, the next-sheet sensor 57 is in an on or off state. That is, when the position of the second sheet Sb is in a predetermined range for attraction to the attraction conveying belt 21, the next-sheet sensor 57 is in an on state. When the position thereof is lower than the predetermined range, the next-sheet sensor 57 is in an off state.

Control of upward and downward movements of the tray 12 in accordance with a signal from the sheet surface sensors 54, 55, and 57 will now be described below.

First, in a state in which the air blowing portion does not blow air, the uppermost surface of the sheet stack on the tray 12 is moved upward until the first sheet surface sensor 54 outputs an ON signal and the second sheet surface sensor 55 is in an off state, as illustrated in FIG. 3. In this state, the distance between the uppermost sheet Sa and the attraction conveying belt 21 is S1.

Next, control during the wait for an attraction operation to be performed by the attraction conveying belt 21 after the air blowing portion blows air is described. In this state, upward and downward movements of the tray 12 are controlled in accordance with an ON signal from the first sheet surface sensor 54 and the second sheet surface sensor 55. The following table shows the upward and downward movements of the tray 12 for the output of an ON signal from each of the first sheet surface sensor 54 and the second sheet surface sensor 55 and for the off state thereof.

TABLE 1

| First sheet surface sensor 54 | Second sheet surface sensor 55 | Tray 12 |
|---|---|---|
| ON | OFF | Ascent |
| ON | ON | Stop |
| OFF | ON | Descent |

Figure 4:
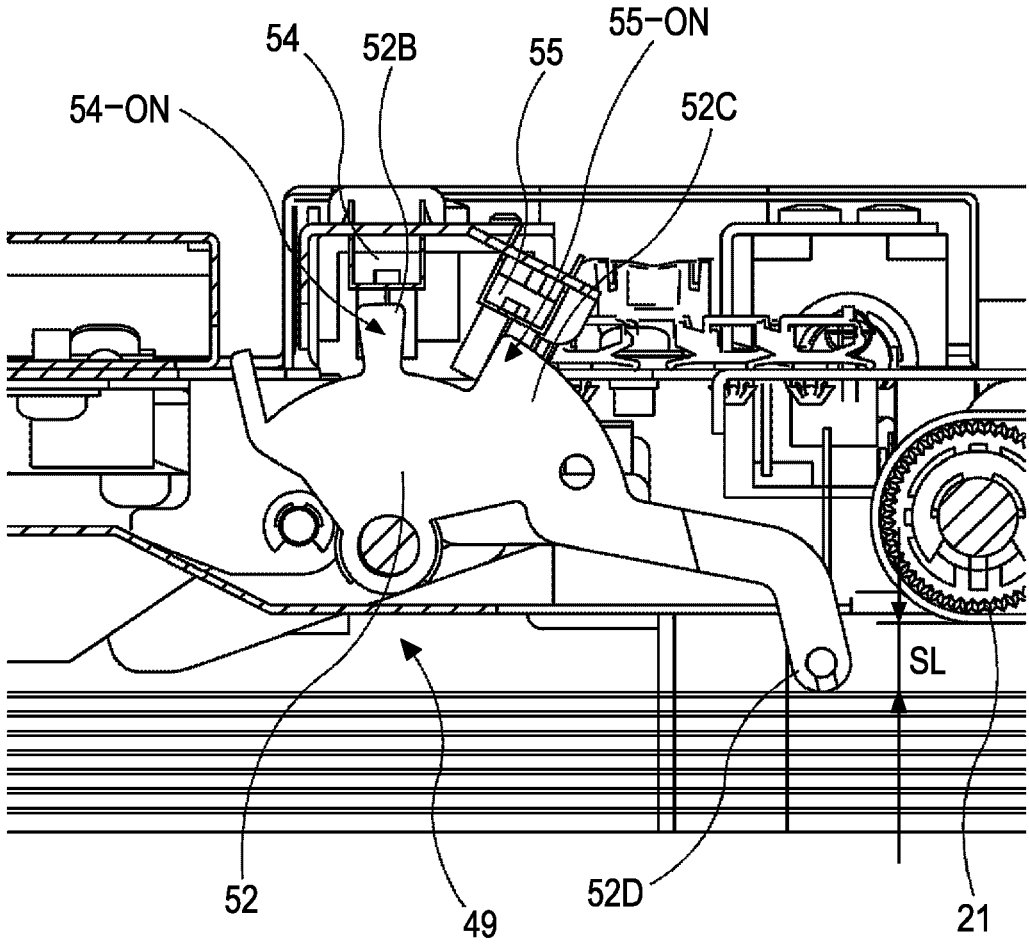
FIG. 4 is a cross-sectional view that illustrates the details of the uppermost-sheet detection mechanism of the sheet feeding device shown in FIG. 1.
Figure 5:
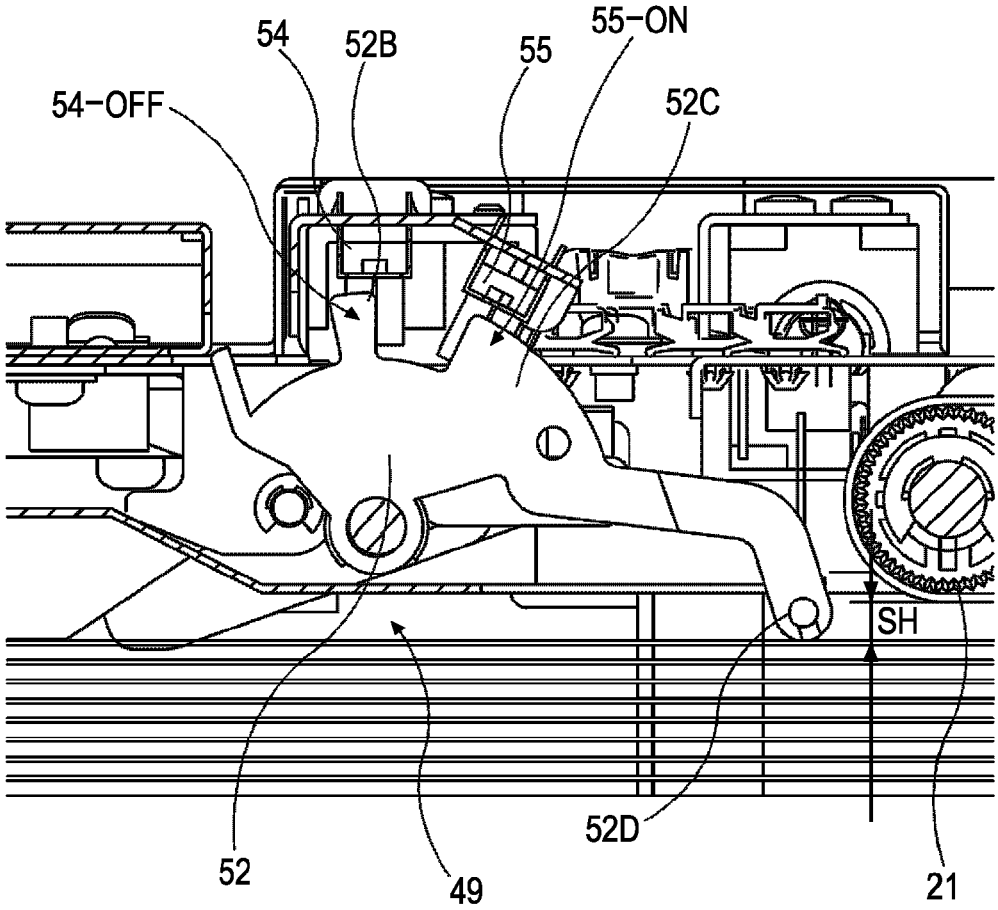
FIG. 5 is a cross-sectional view that illustrates the details of the uppermost-sheet detection mechanism of the sheet feeding device shown in FIG. 1.

As shown in Table 1, when the first sheet surface sensor 54 outputs an ON signal and the second sheet surface sensor 55 is in the off state (i.e., the distance between the uppermost sheet and the attraction conveying belt 21 is S1), as illustrated in FIG. 3, the tray 12 is moved upward. When the first sheet surface sensor 54 and the second sheet surface sensor 55 both output an ON signal (i.e., the distance between the uppermost sheet and the attraction conveying belt 21 is SL), as illustrated in FIG. 4, the tray 12 is stopped. When the first sheet surface sensor 54 is in the off state and the second sheet surface sensor 55 outputs an ON signal (i.e., the distance between the uppermost sheet and the attraction conveying belt 21 is SH), as illustrated in FIG. 5, the tray 12 is moved downward.

A state in which each of the first sheet surface sensor 54 and the second sheet surface sensor 55 outputs an ON signal indicates to a predetermined range to attract and covey the uppermost sheet Sa. More specifically, a predetermined range of heights suited for when the uppermost sheet Sa is attracted and conveyed by the attraction conveying belt 21 corresponds to a state in which the first detection section 52B and the second detection section 52C shield the first sheet surface sensor 54 and the second sheet surface sensor 55, respectively, from light at the same time. This is an intermediate state between the state illustrated in FIG. 4 and that in FIG. 5. In this state, the vertical position of the uppermost sheet is in a predetermined height range (SL-SH: for example, approximately 3 mm).

When the state in which the first sheet surface sensor 54 and the second sheet surface sensor 55 both output an ON signal, which corresponds to the predetermined range for attraction and conveyance, shifts to a state in which the uppermost sheet Sa descends and the second sheet surface sensor 55 is switched off, the tray 12 is moved upward because the uppermost sheet Sa has fallen below the predetermined range. This position is the lower limit for the sheet being in a raised state. When the position of the uppermost sheet Sa has risen too high, the first sheet surface sensor 54 is switched off and the second sheet surface sensor 55 outputs an ON signal. For such a state, the tray 12 is moved downward until the first sheet surface sensor 54 and the second sheet surface sensor 55 both output an ON signal, and is then stopped. This stop position is the upper limit for the sheet being in the raised state. When the uppermost sheet Sa is positioned between the upper limit and the lower limit, the uppermost sheet Sa can be reliably separated and fed by the attraction conveying belt 21. After the uppermost sheet Sa is set in the predetermined range and becomes able to be separated and fed, the attraction conveying belt 21 attracts the uppermost sheet Sa and starts conveying.

Control during continuous feed operation of continuously attracting sheets to the attraction conveying belt 21 and conveying the sheets by the attraction conveying belt 21 will now be described below. During the continuous feed operation, movement of the tray 12 is controlled in accordance with an ON signal from the next-sheet sensor 57.

During the continuous feed operation, the tray 12 is moved only upward without being moved downward. If only detection signals from the first sheet surface sensor 54 and the second sheet surface sensor 55 are used in control of movement of the tray 12 during the continuous feed operation, the following problem arises. As previously described in the Description of the Related Art, because the contact section 52D of the uppermost-surface sensor lever 52 is in contact with the uppermost surface of the uppermost sheet Sa until the uppermost sheet Sa has passed through the attraction conveying belt 21, the uppermost-surface sensor lever 52 cannot come into contact with the upper surface of the next sheet Sb, and thus cannot detect the height of the next sheet Sb.

In contrast, according to the present embodiment, in control of movement of the tray 12 during the feed operation, a detection signal from the next-sheet sensor 57 is used. The tray 12 is moved upward when the next-sheet sensor 57 is in an off state, and the tray 12 is stopped when the next-sheet sensor 57 outputs an ON signal.

The next-sheet detection mechanism 50 operates to set the height of the second sheet Sb raised by an upward movement of the tray 12 in a predetermined range of heights to perform an attraction operation. To this end, it is necessary to equalize the height at which the uppermost sheet Sa is stopped by the uppermost-sheet detection mechanism 49 and the height at which the next sheet Sb is stopped by the next-sheet detection mechanism 50. That is, the height of the uppermost sheet Sa when the first detection section 52B and the second detection section 52C of the uppermost-surface sensor lever 52 shield the first sheet surface sensor 54 and the second sheet surface sensor 55, respectively, from light and the height of the next sheet Sb when the detection section 58B of the next-sheet sensor lever 58 shields the next-sheet sensor 57 from light are set at substantially the same value.

For the uppermost-sheet detection mechanism 49, the uppermost-surface sensor lever 52 comes into contact with the upper surface of a sheet from above the sheet. Accordingly, together with an ascent of the sheet to a position where the upper surface of the sheet is in contact with the attraction conveying belt 21 after an attraction operation to the attraction conveying belt 21 starts, the contact section 52D of the uppermost-surface sensor lever 52 also moves toward the attraction conveying belt 21. At this time, shielding the first sheet surface sensor 54 from light continues, and therefore, the first sheet surface sensor 54 outputs an ON signal.

For the next-sheet detection mechanism 50, the next-sheet sensor lever 58 comes into contact with the upper surface of a sheet from a side of the sheet. In a period from when the attraction conveying belt 21 starts an attraction operation to when the upper surface of the uppermost sheet Sa comes into contact with the attraction conveying belt 21, the contact section 58D of the next-sheet sensor lever 58 initially moves upward together with an ascent of the uppermost sheet Sa. Then, the contact section 58D is separated from the upper surface of the uppermost sheet Sa when the uppermost sheet Sa rises to a position remote from the attraction surface of the attraction conveying belt 21 by a distance Ha. The next-sheet sensor lever 58 is rotated, and the contact section 58D comes into contact with the upper surface of the second sheet Sb. At this time, when the next-sheet sensor 57 is in the off state, which means that the second sheet Sb is not positioned in the predetermined range, the tray 12 is moved upward to move the second sheet Sb upward. When the contact section 58D of the next-sheet sensor lever 58 shields the next-sheet sensor 57 from light and the next-sheet sensor 57 outputs an ON signal, the tray 12 is stopped. At the stop position of the tray 12, the next sheet Sb is positioned in the predetermined range for attraction.

The sequence of control of upward and downward movements of the tray 12 in accordance with detection by the uppermost-sheet detection mechanism 49 and the next-sheet detection mechanism 50 will now be described below.

First, an initial operation is described. The initial operation is an operation of moving upward or downward the tray 12 to set the uppermost sheet Sa of the sheet stack on the tray 12 at a position where the sheet can be fed after, for example, supply of sheets. To this end, when the tray 12 is raised by air blown through the loosening nozzle 33 and the separation nozzle 34, the upward and downward movements of the tray 12 are controlled such that the distance between the uppermost sheet Sa and the belt surface of the attraction conveying belt 21 is appropriately set.

First, when the repository 11 is drawn out of the printer body 1000, the tray 12 in the repository 11 descends to a predetermined position at which sheets can be supplied or the current sheets can be replaced. When the repository 11 is remounted in the printer body 1000, the sheets are moved upward by an ascent of the tray 12, and the upper surface of the uppermost sheet Sa comes into contact with the contact section 52D of the uppermost-surface sensor lever 52. Thereafter, when the tray 12 further ascends, the contact section 52D is pushed upward, and the uppermost-surface sensor lever 52 is rotated about the support shaft 53.

As illustrated in FIG. 3, when the distance between the upper surface of the uppermost sheet and the belt surface of the attraction conveying belt 21 is S1, the first detection section 52B of the uppermost-surface sensor lever 52 shields the first sheet surface sensor 54 from light. At this time, the second sheet surface sensor 55 has not yet been shielded from light by the second detection section 52C of the uppermost-surface sensor lever 52. Then, the tray 12 is further moved upward. When the first sheet surface sensor 54 and the second sheet surface sensor 55 both output an ON signal, the tray 12 is stopped.

Subsequently, after the tray 12 is stopped, blowing air through the loosening nozzle 33 and the separation nozzle 34 starts to raise sheets. When air is blown in this way, unfortunately, upper dense sheets of a group of sheets to be raised may be raised above the upper-limit position. In this case, many sheets are present at a position where the distance between the belt surface of the attraction conveying belt 21 and the upper surface of the uppermost sheet Sa is smaller than the distance SH, as illustrated in FIG. 5, i.e., a position more adjacent to the attraction conveying belt 21. At this time, therefore, the sheet cannot be separated and fed.

In this state, the second detection section 52C of the uppermost-surface sensor lever 52 shields the second sheet surface sensor 55 from light and the second sheet surface sensor 55 outputs an ON signal, whereas shielding the first sheet surface sensor 54 from light by the first detection section 52B is cancelled and the first sheet surface sensor 54 is in the off state.

In this state, the tray 12 is moved downward to set the uppermost sheet Sa at an appropriate sheet feed position. More specifically, the tray 12 is moved downward to a position at which the first sheet surface sensor 54 and the second sheet surface sensor 55 of the uppermost-sheet detection mechanism 49 output an ON signal. When the uppermost sheet Sa is positioned in the predetermined range for attraction to the attraction conveying belt 21, the controlling unit C waits for an output of a sheet feed signal Cf from a controller (not shown) in the image forming apparatus. When the controlling unit C receives the sheet feed signal Cf, an operation of attracting and conveying the sheet starts.

Figure 6:
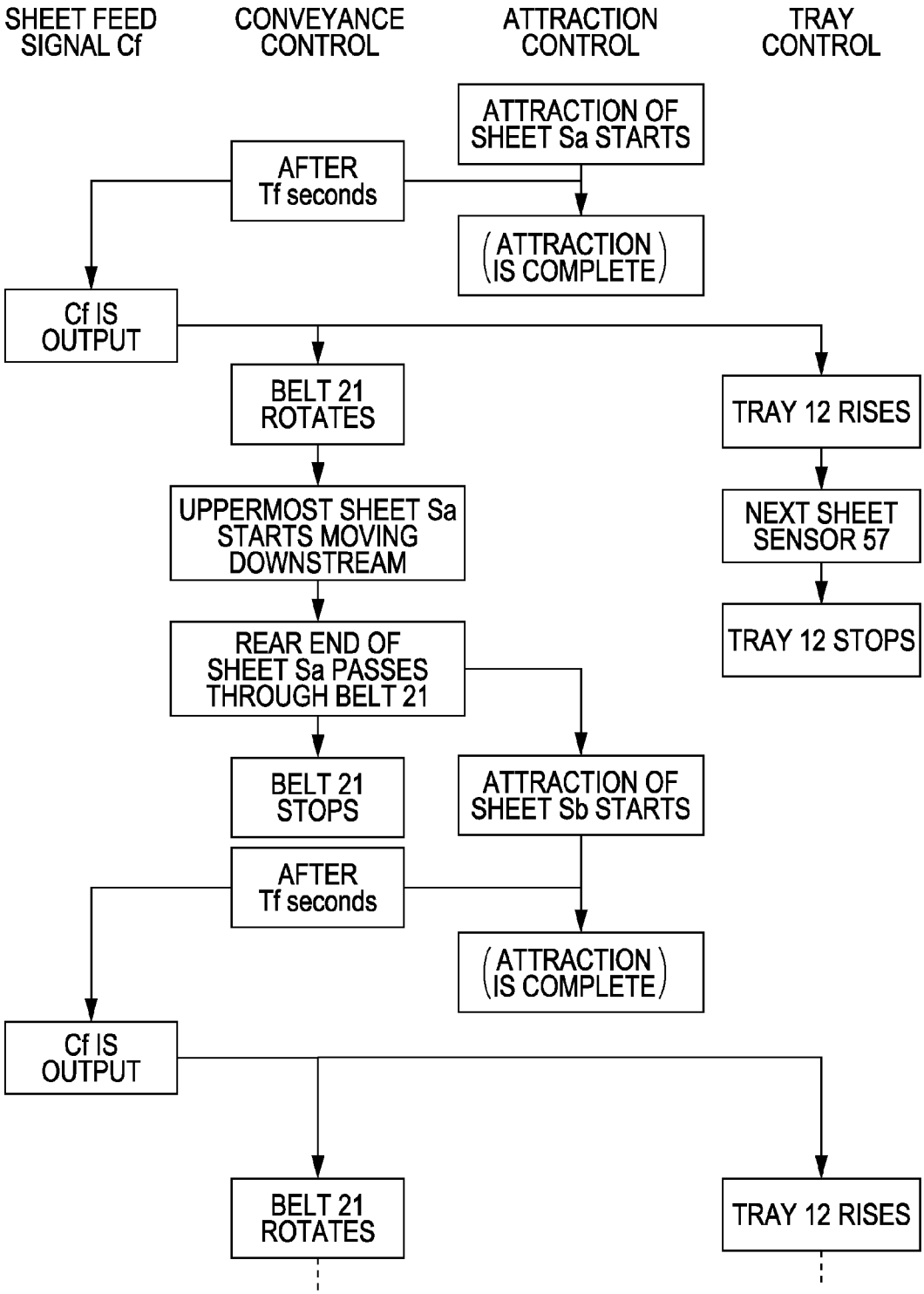
FIG. 6 is a timing chart that shows control performed by the sheet feeding device shown in FIG. 1.

Control of the position of the upper surface of a sheet during continuous feed operation after the completion of the initial operation will now be described below. FIG. 6 illustrates a timing chart for this control. The timing chart shows the relationship among control of conveyance by the attraction conveying belt 21, control of attraction of a sheet by the attraction mechanism, and control of upward and downward movements of the tray 12 in terms of time. In FIG. 6, time progresses downward. The same position in a lateral direction indicates the same time.

Figure 8:
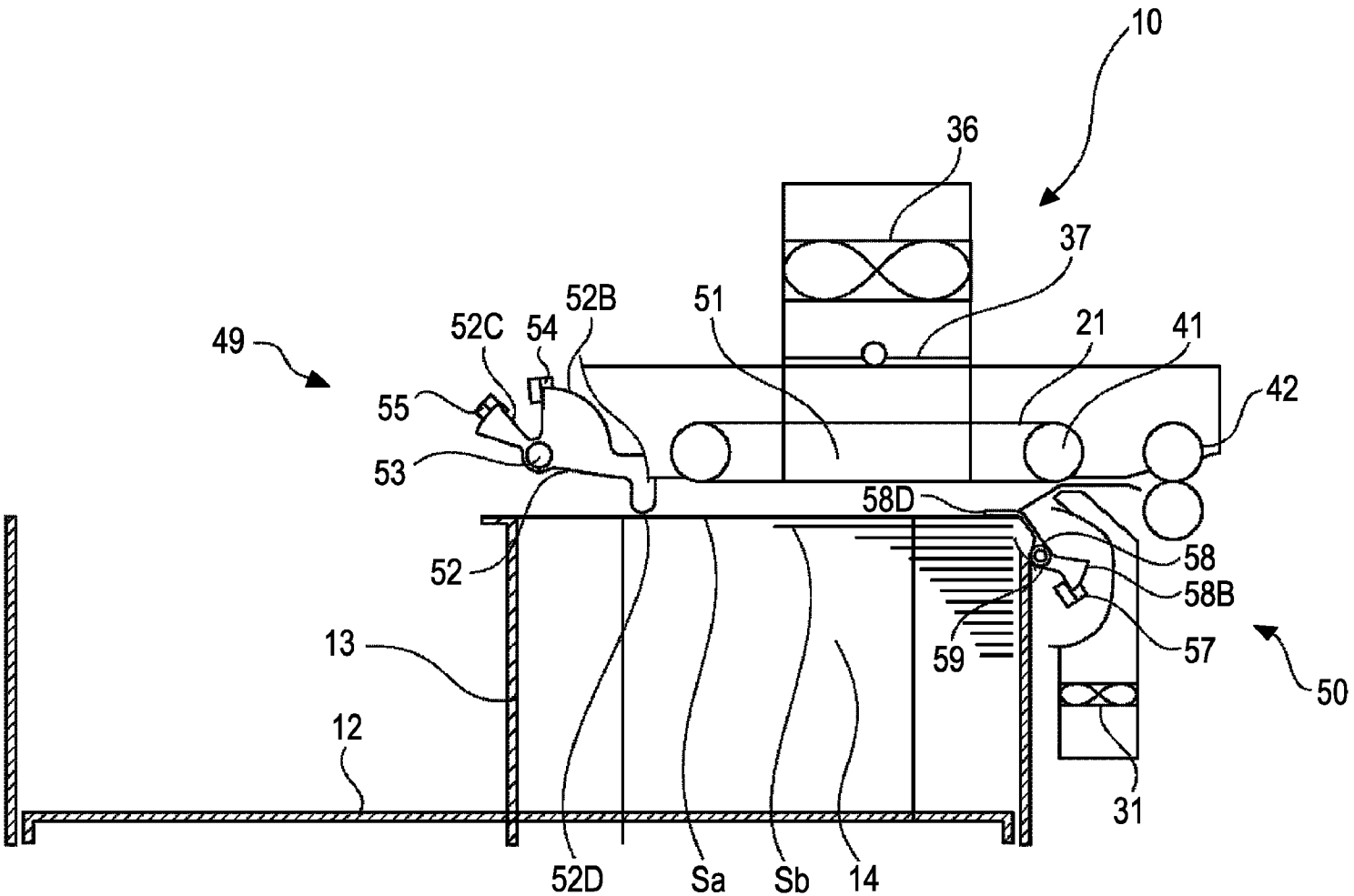
FIG. 8 is an illustration for describing an operation of the sheet feeding device shown in FIG. 1.

After the completion of the initial operation, as illustrated in FIG. 8, the contact section 52D of the uppermost-surface sensor lever 52 is in contact with the upper surface of the uppermost sheet Sa, and the first detection section 52B and the second detection section 52C shield the first sheet surface sensor 54 and the second sheet surface sensor 55, respectively, from light. Similarly, the contact section 58D of the next-sheet sensor lever 58 is also in contact with the upper surface of the uppermost sheet Sa, and the contact section 58D shields the next-sheet sensor 57 from light. At this time, the upper surface of the second sheet Sb, which is positioned immediately below the uppermost sheet Sa, is in contact with none of the contact sections of the sensor levers.

To feed sheets, first, the uppermost sheet Sa is attracted to the attraction conveying belt 21. After the attraction is completed, the uppermost sheet Sa is conveyed at a predetermined timing. In an initial attraction operation, the attraction fan 36 is operated to attract the uppermost sheet Sa to the attraction conveying belt 21. At this time, the first sheet surface sensor 54 and the second sheet surface sensor 55 of the uppermost-sheet detection mechanism 49 are shielded from light by the first detection section 52B and the second detection section 52C, respectively. The contact section 58D of the next-sheet sensor lever 58 is separated from the upper surface of the uppermost sheet Sa and is in contact with the upper surface of the next sheet Sb. When the next sheet Sb is not in the predetermined range, the next-sheet sensor 57 is not shielded from light and is in the off state (the state shifts from FIG. 9 to FIG. 10).

After the completion of the attraction operation, the attraction fan 36 is operated. Thereafter, after a lapse of a predetermined period of time Tf, a sheet feed signal Cf transmitted from the controller (not shown) in the image forming apparatus is received. In response to this, the attraction conveying belt 21 is rotated, and conveyance of the sheet starts. When the sheet Sa passes through a pair of drawing rollers 42 and the leading end of the sheet Sa is detected by a sheet detecting unit, the operation of the attraction fan 36 is stopped. Time Ts from when the leading end of the sheet Sa reaches the sheet detecting unit to when the trailing end of the sheet Sa passes through the attraction conveying belt 21 is calculated in advance using the length of the sheet Sa in the conveying direction and the conveying speed. After a lapse of time Ts from when the leading end of the sheet Sa reaches the sheet detecting unit, the rotation of the attraction conveying belt 21 is stopped.

During this operation, when the uppermost sheet Sa reaches a position at which the distance between the uppermost sheet Sa and the attraction surface of the attraction conveying belt 21 is Ha, the contact section 58D of the next-sheet sensor lever 58 is separated from the upper surface of the uppermost sheet Sa and comes into contact with the upper surface of the second sheet Sb. When the second sheet Sb is not positioned in the predetermined range, the next-sheet sensor 57 is not shielded by the next-sheet sensor lever 58 from light and is in the off state.

Figure 10:
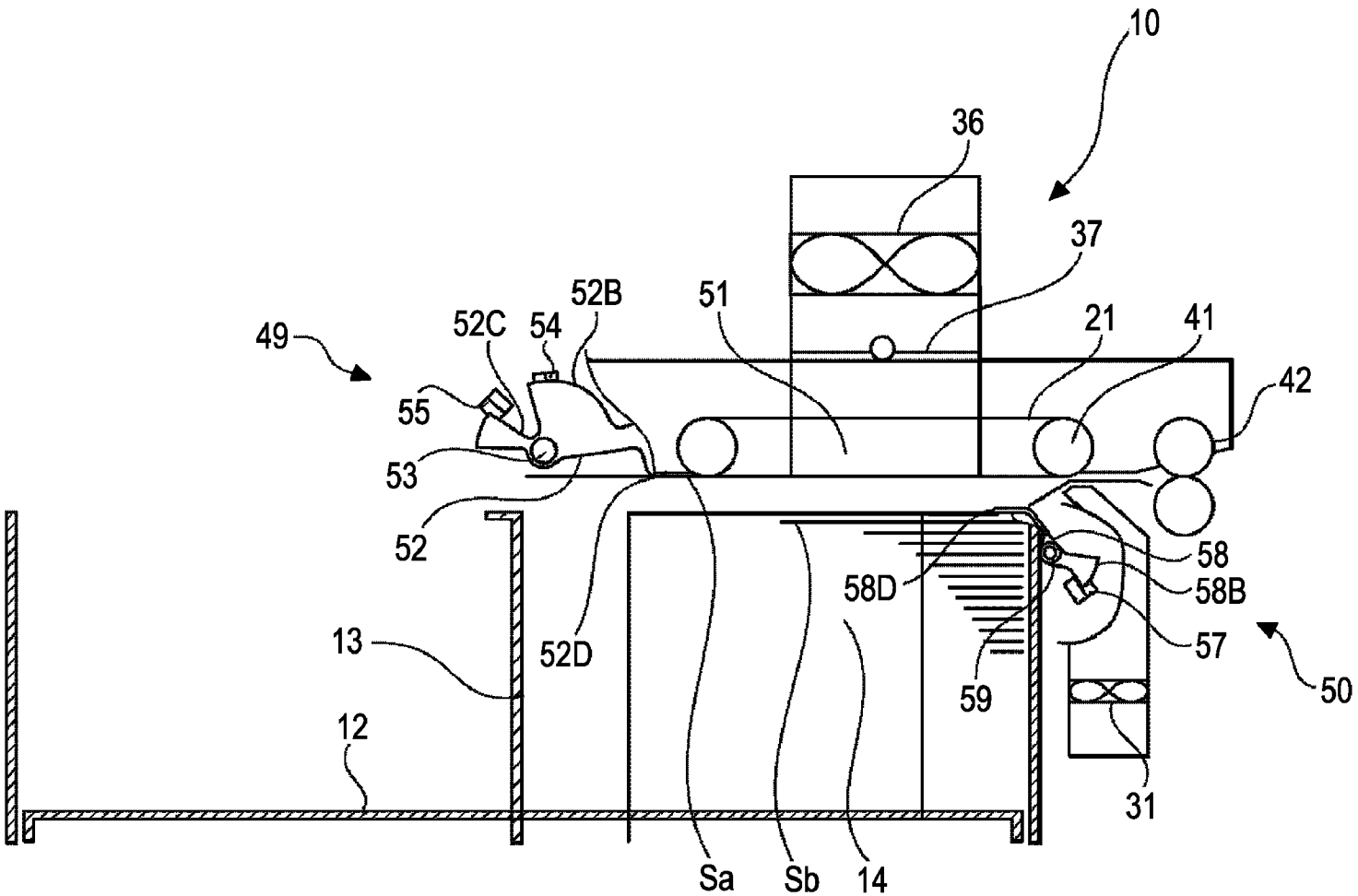
FIG. 10 is still another illustration for describing an operation of the sheet feeding device shown in FIG. 1.

Accordingly, after a lapse of a predetermined period of time Tf from when the sheet Sa is attracted, the contact section 58D of the next-sheet sensor lever 58 is in contact with the upper surface of the next sheet Sb and the next-sheet sensor 57 is in the off state. As a result, the tray 12 is moved upward. When the next-sheet sensor lever 58 is rotated and the detection section 58B shields the next-sheet sensor 57 from light, the next-sheet sensor 57 outputs an ON signal. As a result, the upward movement of the tray 12 is stopped. At this time, as illustrated in FIG. 10, the distance between the belt surface of the attraction conveying belt 21 and the upper surface of the next sheet Sb is appropriate. When the contact section 58D of the next-sheet sensor lever 58 is separated from the uppermost sheet Sa and comes into contact with the upper surface of the second sheet Sb, the next-sheet sensor 57 may be still shielded and output an ON signal. In this case, the second sheet Sb is positioned in the predetermined range for attraction. Thus, the tray 12 is not moved upward.

As described above, according to the present embodiment, at an initial state, the upward and downward movements of the tray 12 are controlled in accordance with a signal output from the first sheet surface sensor 54 and the second sheet surface sensor 55 depending on the height of the uppermost sheet Sa. In a continuous feed operation, the upward and downward movements of the tray 12 are controlled in accordance with a signal output from the next-sheet sensor 57 depending on the height of the second sheet Sb. Accordingly, the height of the second sheet Sb to be next fed can be controlled before the uppermost sheet Sa passes through the attraction conveying belt 21. This can reduce the interval between conveyance of the uppermost sheet Sa and that of the second sheet Sb and thus increase productivity in the image forming portion.

A second embodiment will now be described below with reference to FIGS. 11 and 12. In the first embodiment, after a lapse of a predetermined period of time Tf from when the attraction fan 36 is operated, the sheet feed signal Cf is output. Accordingly, when the sheet is ready to be fed, the attraction has been completed. In response to the output of the sheet feed signal Cf, the position of the upper surface of the next sheet Sb is controlled.

Figure 11:
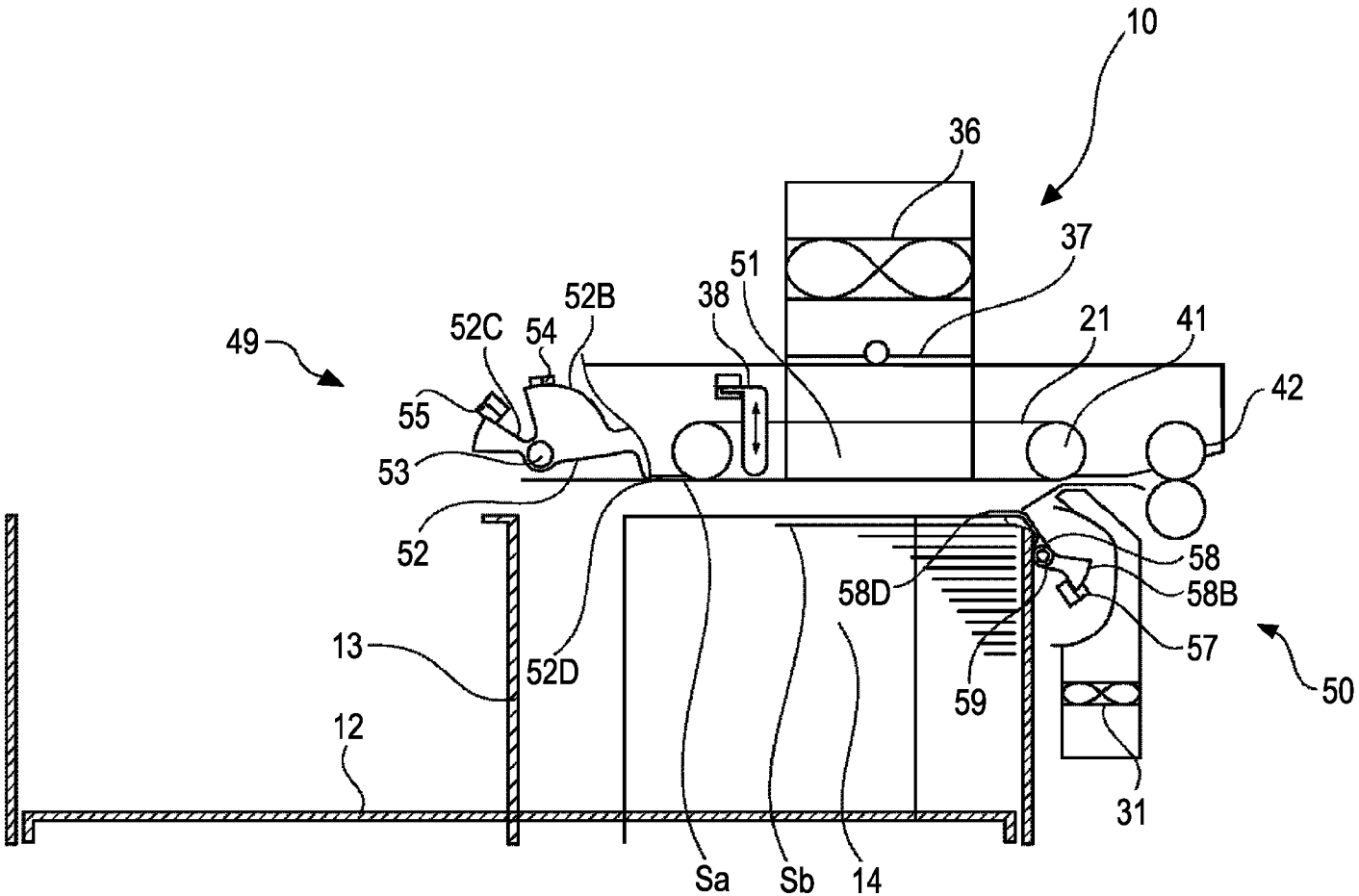
FIG. 11 is a cross-sectional view of the sheet feeding device according to a second embodiment.
Figure 12:
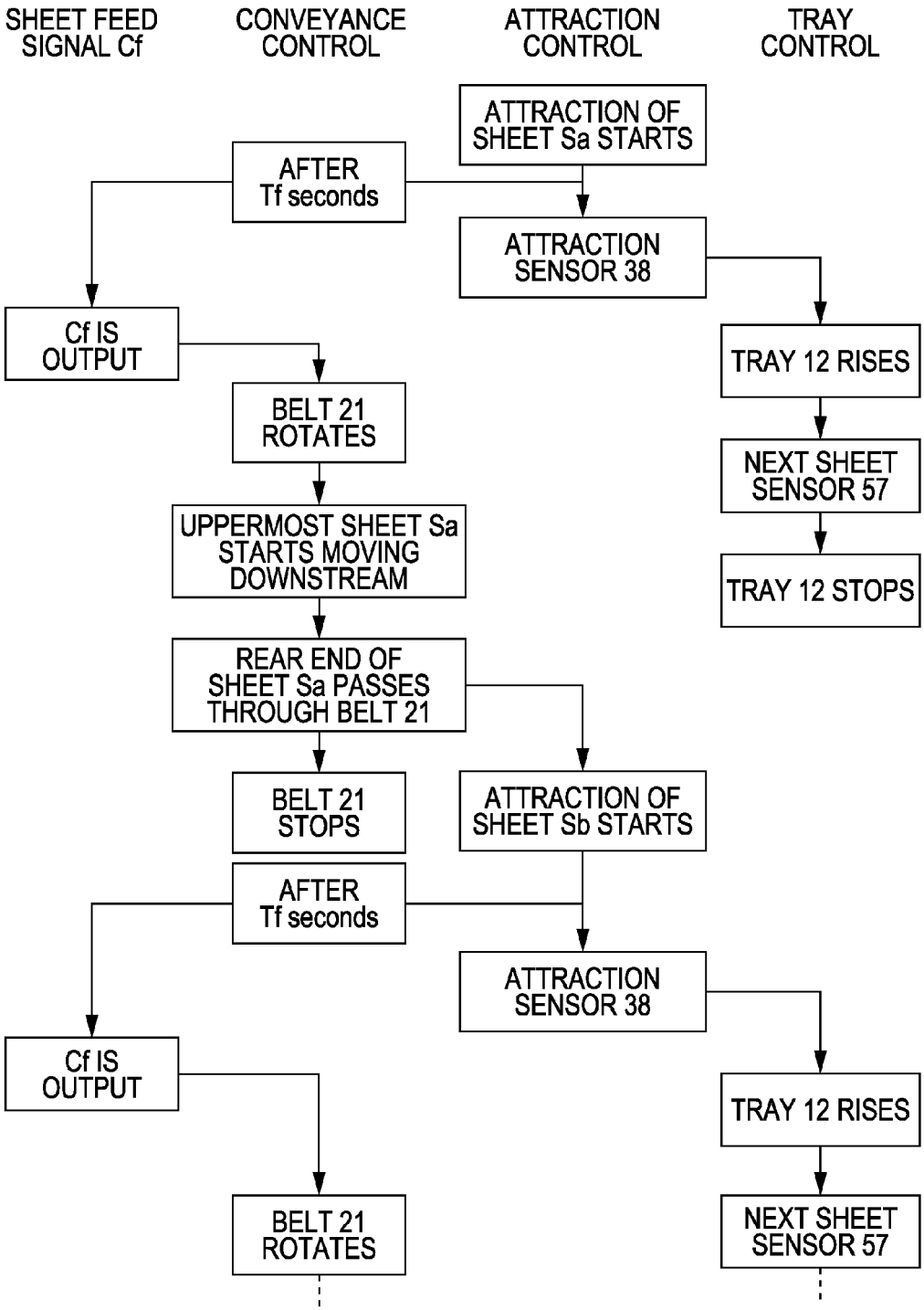
FIG. 12 is a timing chart that shows control of the sheet feeding device shown in FIG. 11.

In contrast, according to the second embodiment, as illustrated in FIG. 11, the sheet feeding device 10 includes an attraction sensor 38 capable of detecting completion of the attraction of the sheet S. The position of the upper surface of the second sheet Sb is controlled in response to the output of an ON signal from the attraction sensor 38. Accordingly, as illustrated in a timing chart shown in FIG. 12, the position of the upper surface of the second sheet Sb can be controlled before a lapse of time Tf. As a result, the interval between a feed of the uppermost sheet Sa and that of the second sheet Sb can be reliably reduced. The other structures in the second embodiment are substantially the same as those in the first embodiment, so the description thereof is not repeated here.

Figure 13A:
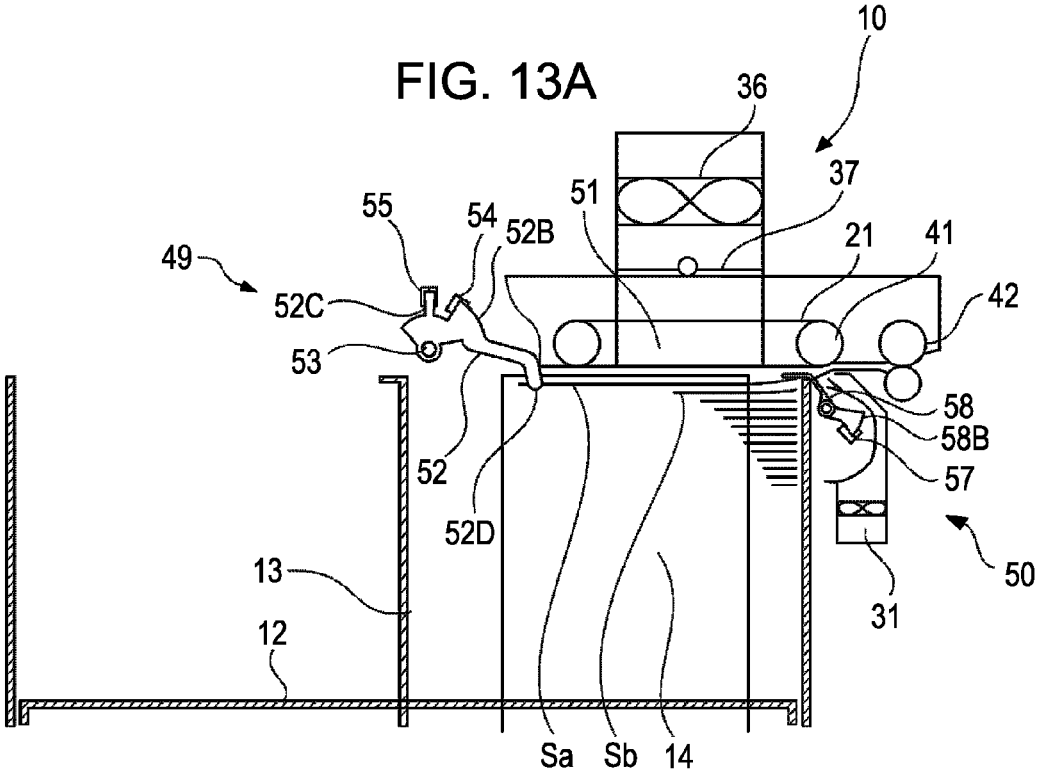
FIGS. 13A and 13B are cross-sectional views of the sheet feeding device according to a third embodiment.
Figure 13B:
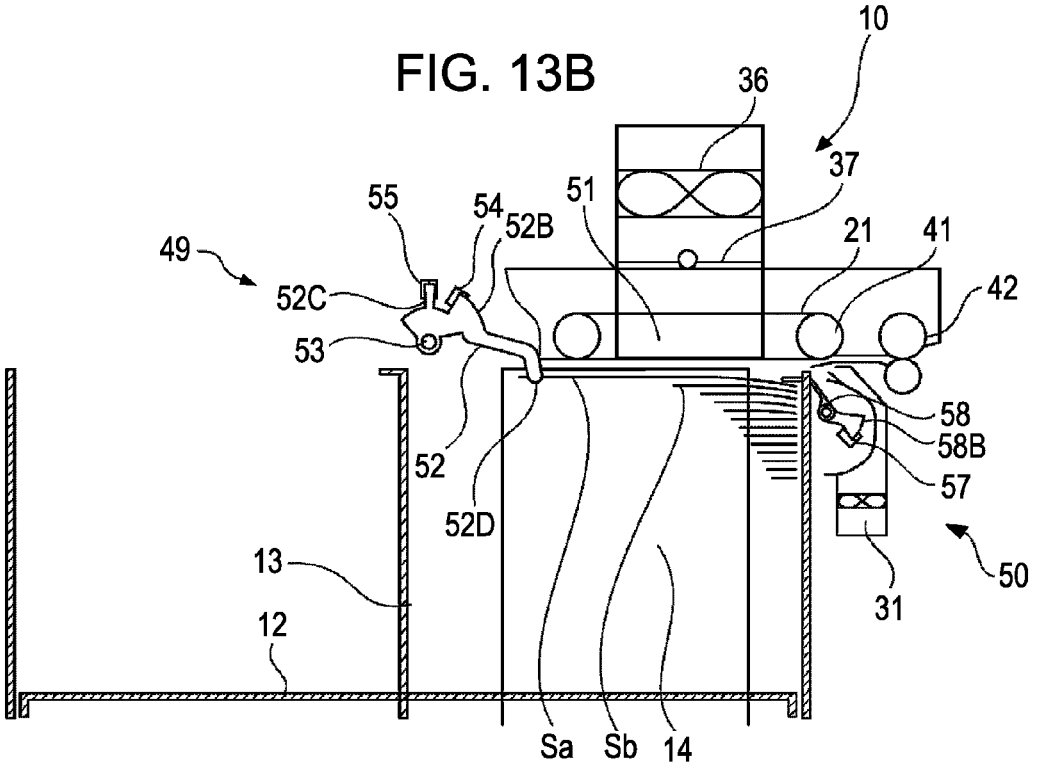

A third embodiment will now be described below with reference to FIGS. 13A and 13B. The third embodiment differs from the embodiments described above in that the sheet feeding device 10 includes a lifting and lowering unit that supports and is capable of lifting and lowering the next-sheet detection mechanism 50. This different structure is described below. The other structures are substantially the same as those in the above embodiments, so the description thereof is not repeated here.

The next-sheet detection mechanism 50 is supported by the lifting and lowering unit (not shown) so as to be liftable and lowerable. Before the upward and downward movements of the tray 12 are controlled in an initial operation, the next-sheet detection mechanism 50 is positioned above the sheets such that the contact section 58D of the next-sheet sensor lever 58 is separated from the uppermost sheet Sa.

To move the uppermost sheet Sa into the predetermined range at which the sheet can be attracted, the tray 12 is moved upward. When the tray 12 is moved upward, the upper surface of the uppermost sheet Sa comes into contact with the contact section 52D of the uppermost-surface sensor lever 52 and the first detection section 52B and the second detection section 52C shield the first sheet surface sensor 54 and the second sheet surface sensor 55, respectively, from light. Then, the uppermost sheet Sa is positioned in the predetermined range. After this control, the next-sheet detection mechanism 50 is gradually lowered.

When the next-sheet detection mechanism 50 is further lowered after the contact section 58D of the next-sheet sensor lever 58 comes into contact with the upper surface of the uppermost sheet Sa, the next-sheet sensor lever 58 is rotated by the uppermost sheet Sa. Thereafter, the next-sheet detection mechanism 50 is lowered until the next-sheet sensor lever 58 is rotated and the detection section 58B shields the next-sheet sensor 57 from light.

In contrast to the first embodiment, in which the detection position of the next-sheet detection mechanism 50 is fixed, according to the present embodiment, the detection position can be adjusted to deal with a sheet stack that includes an uppermost sheet Sa having an irregular end shape, such as a curl. More specifically, as illustrated in FIG. 13A, when the leading end of the sheet stack is curled upward, the next-sheet detection mechanism 50 comes into contact with the leading end of the uppermost sheet Sa and stops, and the vertical position is set. At this stop position, the next-sheet detection mechanism 50 can detect the sheet at a position above the height at which the uppermost sheet Sa is stopped by the uppermost-sheet detection mechanism 49. On the other hand, as illustrated in FIG. 13B, when the leading end of the sheet stack is curled downward, the next-sheet detection mechanism 50 comes into contact with the leading end of the uppermost sheet Sa and stops, and the vertical position is set. At this stop position, the next-sheet detection mechanism 50 can detect the sheet at a position below the height at which the uppermost sheet Sa is stopped by the uppermost-sheet detection mechanism 49.

As described above, the position of the next-sheet detection mechanism 50 can be vertically adjusted by the lifting and lowering unit in accordance with the shape of the end of the sheet. Accordingly, even when a curled sheet stack is to be fed, accuracy in control of the position of the upper surface of the second sheet Sb can be improved. Thus, productivity can be further enhanced.

Figure 14:
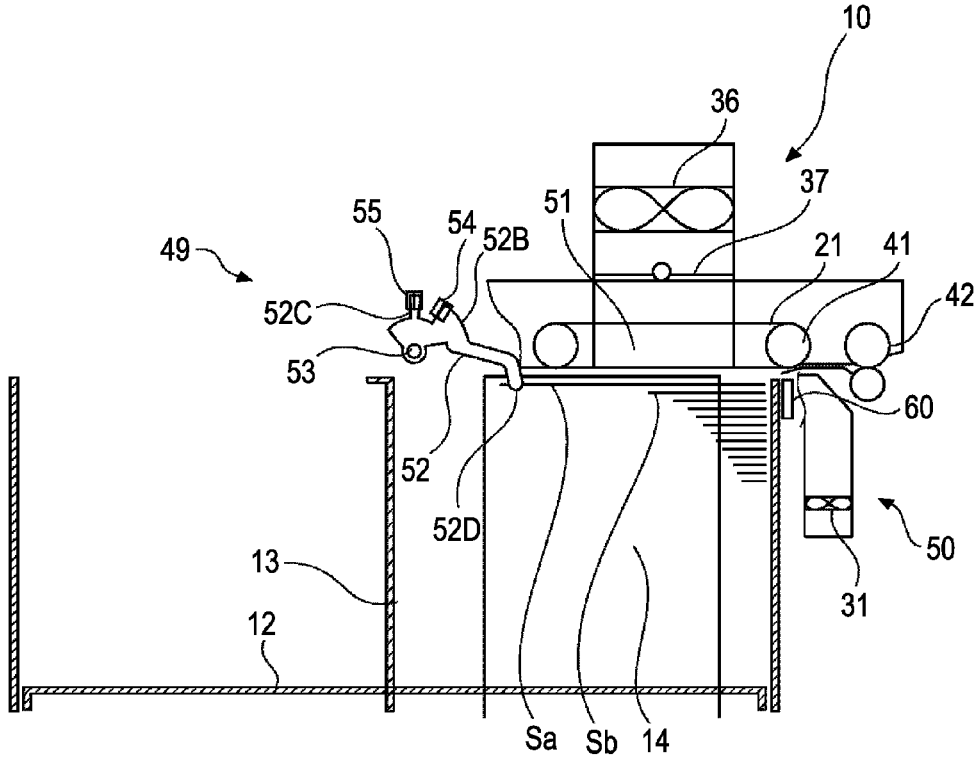
FIG. 14 is a cross-sectional view of the sheet feeding device according to a fourth embodiment.

A fourth embodiment will now be described below. In the fourth embodiment, as illustrated in FIG. 14, the next-sheet detection mechanism 50 is realized by an image sensor 60. This different structure is described below. The other structures are substantially the same as those in the above embodiments, so the description thereof is not repeated here.

In the present embodiment, the image sensor 60 reads information on an end of the stacked sheets as image data, and the vertical position of the sheet end is stored in a memory from the read image. The upward and downward movements of the tray 12 are controlled based on the data.

More specifically, the image sensor 60 reads the position of the end of the second sheet Sb when the uppermost sheet Sa is attracted to the attraction conveying belt 21. The tray 12 is moved upward in accordance with the read position. The tray 12 is stopped when the height of the second sheet Sb reaches a predetermined position. Accordingly, the second sheet Sb can wait in the predetermined range for attraction.

In an initial operation, the tray 12 is moved upward, the uppermost sheet Sa comes into contact with the contact section 52D of the uppermost-surface sensor lever 52, and the first detection section 52B and the second detection section 52C shield the first sheet surface sensor 54 and the second sheet surface sensor 55, respectively, from light. Thereafter, the height of the end of the uppermost sheet Sa is stored in a memory using the image sensor 60. After the uppermost sheet Sa is attracted to the attraction conveying belt 21, the tray 12 is moved upward, and is stopped when the image sensor 60 detects that the height of the end of the next sheet Sb has reached a height that the controller (not shown) causes the memory to store. Accordingly, even when the sheet is curled, as described in the third embodiment, the sheet can be controlled such that an area of the sheet to be attracted is positioned at a predetermined height.

The embodiments described above can be implemented alone or in any combination.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-341408 filed Dec. 19, 2006, which is hereby incorporated by reference herein in its entirety.

What is claimed is:

1. A sheet feeding device comprising:

a tray configured to support sheets, the tray being movable upward and downward;

a driving portion configured to move the tray upwardly and downwardly;

an air blowing portion configured to blow air so as to raise the sheets supported on the tray;

an uppermost-sheet detection mechanism configured to detect a height of the uppermost sheet of the sheets raised by the air blown from the air blowing portion;

a control portion configured to control upward and downward movements of the tray in accordance with detection by the uppermost-sheet detection mechanism such that the uppermost sheet is positioned in a predetermined range;

an attraction conveying portion having an attracting portion and a conveying portion and is configured to attract an uppermost sheet of the sheets raised by the air blowing portion by the attracting portion and to convey the attracted sheet by the conveying portion; and a next-sheet detection mechanism configured to detect a height of a next sheet subsequent to the uppermost sheet after an attraction operation of the uppermost sheet is started by the attraction portion and before the uppermost sheet is conveyed by the attraction conveying portion.

2. The sheet feeding device according to claim 1, wherein, when it is judged that the next sheet is not in the predetermined range in accordance with detection by the next-sheet detection mechanism, the control portion controls the driving portion to move the tray upwardly or downwardly such that the height of the next sheet subsequent to the uppermost sheet is in the predetermined range.

3. The sheet feeding device according to claim 1, wherein the next-sheet detection mechanism includes:

a next-sheet detection lever disposed adjacent to a side of the tray and configured to come into contact with an upper surface of the sheets supported on the tray; and a next-sheet sensor configured to output a signal in accordance with a position of the next-sheet detection lever, and wherein, when the uppermost sheet raised by the air blown from the air blowing portion reaches a certain position, the next-sheet detection lever comes into contact with an upper surface of the next sheet subsequent to the uppermost sheet so as to detect the height of the next sheet.

4. The sheet feeding device according to claim 2, wherein the next-sheet detection mechanism is movable upward and downward, wherein, during control of the upward and downward movements of the tray in accordance with detection by the uppermost-sheet detection mechanism, the next-sheet detection mechanism is positioned above the sheet such that a contact section of the next-sheet detection mechanism to come into contact with the sheet is not in contact with the sheet, and wherein, after the upward and downward movements of the tray have been controlled in accordance with detection by the uppermost-sheet detection mechanism, the next-sheet detection mechanism is lowered and stopped in accordance with the uppermost sheet, and a vertical position of the next-sheet detection mechanism is set.

5. The sheet feeding device according to claim 1, wherein the next-sheet detection mechanism includes an image sensor disposed adjacent to a side of the sheets supported on the tray and configured to detect a vertical position of an end of the sheets raised by the air blown from the air blowing portion, and the upward and downward movements of the tray are controlled in accordance with data from the image sensor.

6. The sheet feeding device according to claim 1, wherein the attraction conveying portion includes an attraction sensor configured to detect that the uppermost sheet has been attracted by the attraction conveying portion, and the upward and downward movements of the tray are controlled in accordance with detection by the attraction sensor and detection by the next-sheet detection mechanism.

7. An image forming apparatus including an image forming portion configured to form an image on a sheet fed from a sheet feeding device, the image forming apparatus comprising:

a tray configured to support sheets, the tray being movable upward and downward;

a driving portion configured to move the tray upwardly and downwardly;

an air blowing portion configured to blow air for raising the sheets supported on the tray;

an uppermost-sheet detection mechanism configured to detect a height of the uppermost sheet of the sheets raised by the air blown from the air blowing portion;

a control portion configured to control upward and downward movements of the tray in accordance with detection by the uppermost-sheet detection mechanism such that the uppermost sheet is positioned in a predetermined range;

an attraction conveying portion which has a attracting portion and a conveying portion and is configured to attract an uppermost sheet of the sheets raised by the air blowing portion by the attracting portion and to convey the attracted sheet by the conveying portion; and a next-sheet detection mechanism configured to detect a height of a next sheet subsequent to the uppermost sheet after an attraction operation of the uppermost sheet is started by the attraction portion and before the uppermost sheet is conveyed by the attraction conveying portion.

8. The image forming apparatus according to claim 7, wherein when it is judged that the next sheet is not in the predetermined range in accordance with detection by the next-sheet detection mechanism, the control portion controls the driving portion to move the tray upwardly or downwardly such that the height of the next sheet subsequent to the uppermost sheet is in the predetermined range.

9. The image forming apparatus according to claim 7, wherein the next-sheet detection mechanism includes:

a next-sheet detection lever disposed adjacent to a side of the tray and configured to come into contact with an upper surface of the sheets supported on the tray; and a next-sheet sensor configured to output a signal in accordance with a position of the next-sheet detection lever, and wherein, when the uppermost sheet raised by the air blown from the air blowing portion reaches a certain position, the next-sheet detection lever comes into contact with an upper surface of the next sheet subsequent to the uppermost sheet so as to detect the height of the next sheet.

10. The image forming apparatus according to claim 8, wherein the next-sheet detection mechanism is movable upward and downward, wherein, during control of the upward and downward movements of the tray in accordance with detection by the uppermost-sheet detection mechanism, the next-sheet detection mechanism is positioned above the sheet such that a contact section of the next-sheet detection mechanism to come into contact with the sheet is not in contact with the sheet, and wherein, after the upward and downward movements of the tray have been controlled in accordance with detection by the uppermost-sheet detection mechanism, the next-sheet detection mechanism is lowered and stopped in accordance with the uppermost sheet, and a vertical position of the next-sheet detection mechanism is set.

11. The image forming apparatus according to claim 7, wherein the next-sheet detection mechanism includes an image sensor disposed adjacent to a side of the sheets supported on the tray and configured to detect a vertical position of an end of the sheets raised by the air blown from the air blowing portion, and the upward and downward movements of the tray are controlled in accordance with data from the image sensor.

12. The image forming apparatus according to claim 7, wherein the attraction conveying portion includes an attraction sensor configured to detect that the uppermost sheet has been attracted by the attraction conveying portion, and the upward and downward movements of the tray are controlled in accordance with detection by the attraction sensor and detection by the next-sheet detection mechanism.

* * * * *